United States Patent [19]

Belokin et al.

[11] Patent Number: 4,854,246

[45] Date of Patent: Aug. 8, 1989

[54] DISPLAY DEVICE AND METHOD OF ASSEMBLY

[76] Inventors: Martin P. Belokin; Normal P. Belokin, both of P.O. Box 1907, Denton, Tex. 76201

[21] Appl. No.: 32,790

[22] Filed: Apr. 1, 1987

[51] Int. Cl.[4] ..... A47B 3/00

[52] U.S. Cl. ..... 108/111; 211/149

[58] Field of Search ..... 108/111, 112, 99, 115, 108/153; 206/491, 491.1, 492, 577; 211/135, 149

[56] References Cited

U.S. PATENT DOCUMENTS

| | | | |
|---|---|---|---|
| 1,625,294 | 4/1927 | Whitesides | 108/99 X |
| 1,881,224 | 10/1932 | Nuckols . | |
| 1,947,746 | 2/1934 | Thomson | 108/111 |
| 2,012,117 | 8/1935 | Barron . | |
| 2,132,785 | 10/1938 | Hu . | |
| 2,150,743 | 3/1939 | Mancuso . | |
| 2,170,356 | 8/1939 | Stocker . | |
| 2,290,144 | 7/1942 | Katz | 108/111 |
| 2,291,265 | 7/1942 | Viglietta | 108/111 X |
| 3,089,632 | 5/1963 | Bartolucci . | |
| 3,126,844 | 3/1964 | Burne et al. | 108/111 |
| 3,300,166 | 1/1967 | Wojchechowski . | |
| 3,372,813 | 3/1968 | Ishida . | |
| 3,576,355 | 4/1971 | Stone | 108/111 X |
| 3,604,751 | 9/1971 | Caigan | 108/112 X |
| 3,685,640 | 8/1972 | Tolaas | 206/44.11 |
| 3,685,775 | 8/1972 | Fortunato | 248/174 |
| 3,877,396 | 4/1975 | Patterson | 108/111 |
| 3,899,126 | 8/1975 | Palmer | 206/491.1 X |
| 3,907,737 | 10/1976 | Smith | 108/111 |
| 3,918,631 | 11/1975 | Hackenberg | 206/491.1 X |

*Primary Examiner*—Kenneth J. Dorner
*Assistant Examiner*—Jose V. Chen
*Attorney, Agent, or Firm*—Wood, Dalton, Phillips Mason & Rowe

[57] ABSTRACT

The inventive display device has a continuous wall structure with first and second, substantially flat, facing wall pairs and a flat shelf portion cut directly out of each of the walls of the wall pairs. The shelf portions are foldable relative to their respective walls between a collapsed position, wherein they are substantially parallel to their associated wall, and a display position, wherein they extend transversely to their associated wall. At at least one corner of the structure, two adjacent walls are foldable against and away from each other about a fold line. The shelf portions on the adjacent walls are interconnected so that with the walls folded against each other the shelf portions reside in their collapsed position and upon the walls being moved away from each other, the shelf portions draw each other away from their respective walls into the display position wherein they cooperatively define a display shelf.

17 Claims, 3 Drawing Sheets

FIG. 2
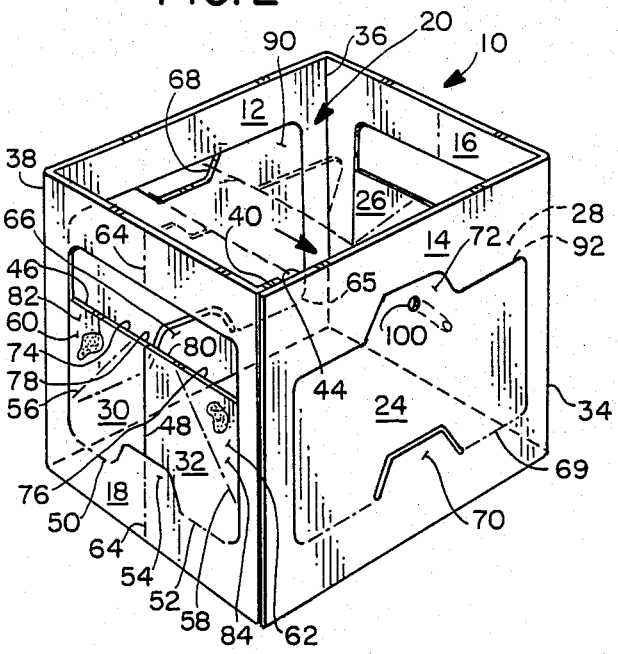
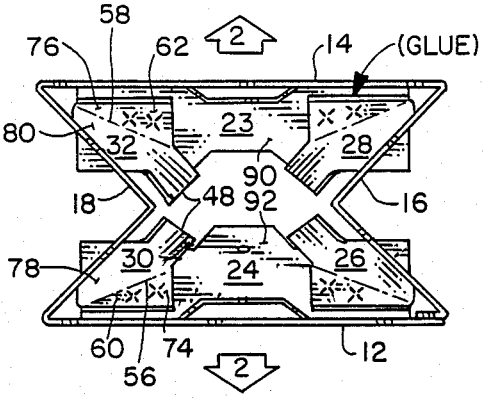
FIG. 9
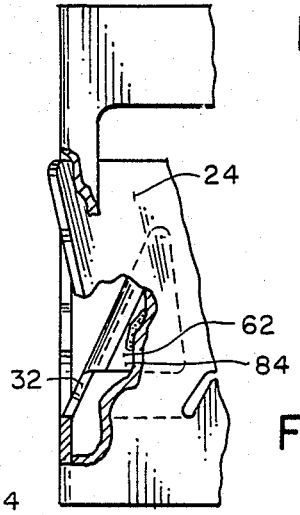
FIG. 8
FIG. 10
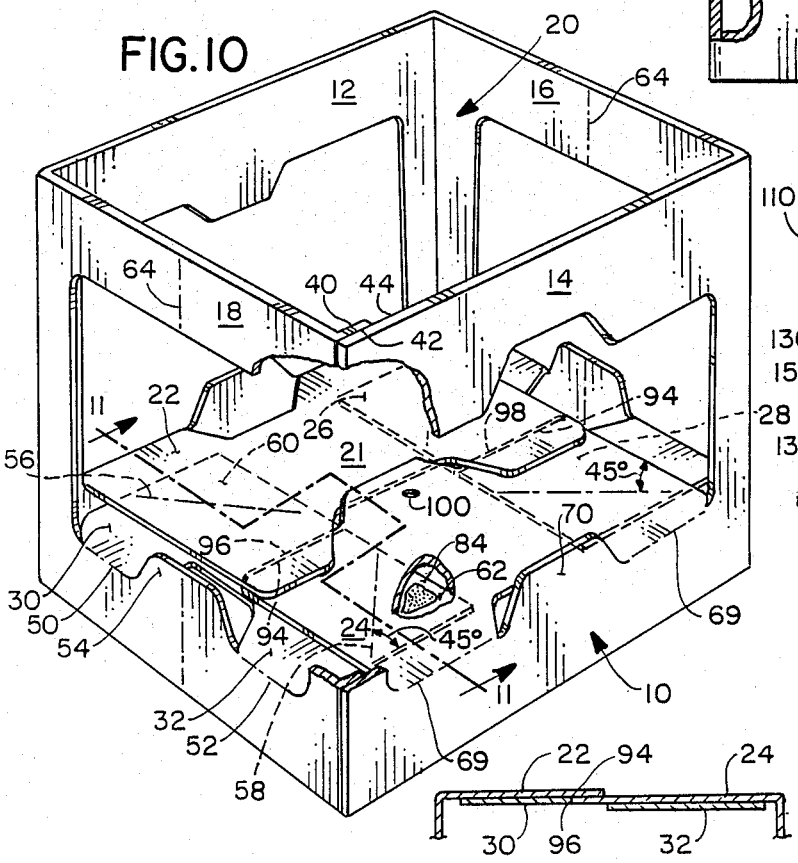
FIG. 11
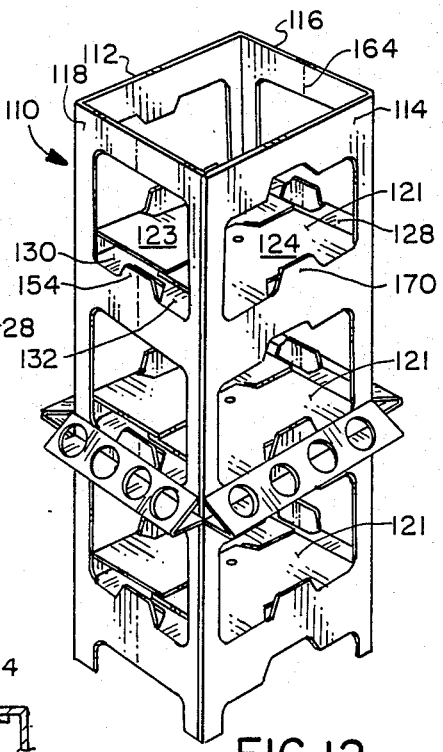
FIG. 12

DISPLAY DEVICE AND METHOD OF ASSEMBLY

BACKGROUND OF THE INVENTION

1. Field of the Invention

This invention relates to devices for supporting and displaying merchandise and, more particularly, to a device that can be selectively collapsed and placed in a display state simply upon moving two facing walls thereon towards and away from each other and to a method for assembling the device.

2. Background Art

Prefabricated display stands are frequently employed in retail establishments to support and display merchandise. It is known to construct stands from cardboard to make them light in weight and reduce manufacturing costs. It is also known to make cardboard display stands collapsible to reduce their size for compact storage and ease of transportation.

Designers of prior art display stands have striven to simplify the transition from collapsed to display states without compromising the integrity of the stand. However, the prior art structures have generally fallen short of achieving these objectives.

For example, in U.S. Pat. No. 3,877,396, to Patterson, a knockdown, multiple shelf display rack is shown that is constructed from numerous, separate elements. One has to place and maintain uprights and shelves together and while doing the latter, put a surrounding sleeve in place. This is time consuming, may require more than one individual to effect assembly and requires a large number of parts, the absence of any one of which may render the structure inoperable.

It is also known to construct cardboard stands from a single blank, as shown in U.S. Pat. No. 3,685,775, to Fortunato. In Fortunato, a fairly intricate folding operation is required to interconnect elements to maintain the structure in its display state. The assembly process is both time consuming and complicated as one must fold each individual element and effect connection between the mating elements through a predetermined sequence of steps.

The present invention is specifically directed to overcoming the above enumerated problems in a novel and simple manner.

SUMMARY OF THE INVENTION

It is the principal objective of the present invention to afford a collapsible display stand that can be changed back and forth between collapsed and display states simply by selectively moving two walls on the structure towards and away from each other.

More specifically, according to the invention the inventive display device has a continuous wall structure with first and second, substantially flat, facing wall pairs and a flat shelf portion cut directly out of each of the walls of the wall pairs. The shelf portions are foldable relative to their respective walls between a collapsed position, wherein they are substantially parallel to their associated wall, and a display position, wherein they extend transversely to their associated wall.

The shelf portions on two of the walls are interconnected in such a manner that upon the facing walls of one of the wall pairs being moved towards each other the interconnected shelf portions assume their collapsed position and, upon the facing walls of the one wall pair being moved away from each other, the interconnected shelf portions draw each other away from their respective walls into their display position wherein they cooperatively define an article display shelf.

At at least one corner of the structure, two adjacent walls are foldable against and away from each other about a fold line. In a preferred form, the shelf portions on the adjacent walls are interconnected in the aforementioned manner. Movement of the walls of the one wall pair towards and away from each other is made possible by the provision of preformed fold lines on the walls of the other wall pair, which makes an accordion-type structure. The walls of the one wall pair remain substantially parallel to each other throughout the transition between collapsed and display states.

Preferably, each of the walls of one of the facing wall pairs has a single, foldable shelf portion and each of the walls of the other wall pair has at least two foldable shelf portions. Each shelf portion on the one wall pair cooperates with two of the shelf portions on the other wall pair in the manner previously described. Upon the walls of the one wall pair being moved away from each other, the six shelf portions automatically simultaneously move down into their display position and cooperatively define a display shelf. In so doing, the shelf portions on the one wall pair situate in mutually overlapping relationship with each other to be mutually supporting.

To accomplish the interconnection of the shelf portions on adjacent walls, a flap is defined by a score line on one of the shelf portions of one of the adjacent walls and is foldable about the line against the shelf portion with which it is integral to expose a flat surface which is facially engaged with and secured as by gluing to a shelf portion on the other of the adjacent walls. The score line is oriented so that the flap is automatically properly aligned for connection to its mating shelf portion with the display device in a collapsed state. The score line bisects the right angle defined by the adjacent walls with the device in a display state i.e. makes a 45° angle with the plane of each of the adjacent walls.

To secure together the mating shelf portions, glue is applied to one side of the flaps after which the device is collapsed. A force can then be applied to the collapsed device, as through the placement of a weight thereon until the glue sets. Proper alignment of the glued parts is assured. Once the glue sets, the walls of the one wall pair can be drawn away from each other thereby unfolding the walls of the other wall pair and automatically defining an article display shelf upon the display state being realized.

In a further aspect of the invention, the shelf portions of the one wall pair fold over center and bind against the shelf portions of the other wall pair to prevent inadvertent collapse of the device. The weight of articles on the shelf further assures that the over center situation of the shelf portions is maintained.

BRIEF DESCRIPTION OF THE DRAWINGS

FIG. 2 is a perspective view of the display device in a partially assembled state with the blank in FIG. 1 folded to define a continuous wall structure;

FIG. 8 is an enlarged, fragmentary, side elevation view of one corner of the display device in a partially collapsed state;

FIG. 9 is a bottom view of the display device in a partially collapsed state;

FIG. 10 is an enlarged, perspective view of the display device in its display state;

FIG. 11 is a sectional view of cooperating shelf portions taken along line 11—11 of FIG. 10; and FIG. 12 is a perspective view of an alternative form of display device according to the present invention and having multiple display shelves.

DETAILED DESCRIPTION OF THE DRAWINGS

Referring initially to FIGS. 1–11, a preferred embodiment of the invention is depicted. The device in FIGS. 1–11 is a single shelf construction, as opposed to that structure in FIG. 12, which is constructed in accordance with the inventive principles, but has multiple shelves.

The partially assembled display device in FIG. 2 comprises an endless wall structure at 10 that has a first facing pair of walls 12, 14 and a second pair of facing walls 16, 18, which walls cooperatively define a storage space 20, for articles to be placed on an upwardly facing shelf 21 (FIG. 10) for display.

Figure 1:
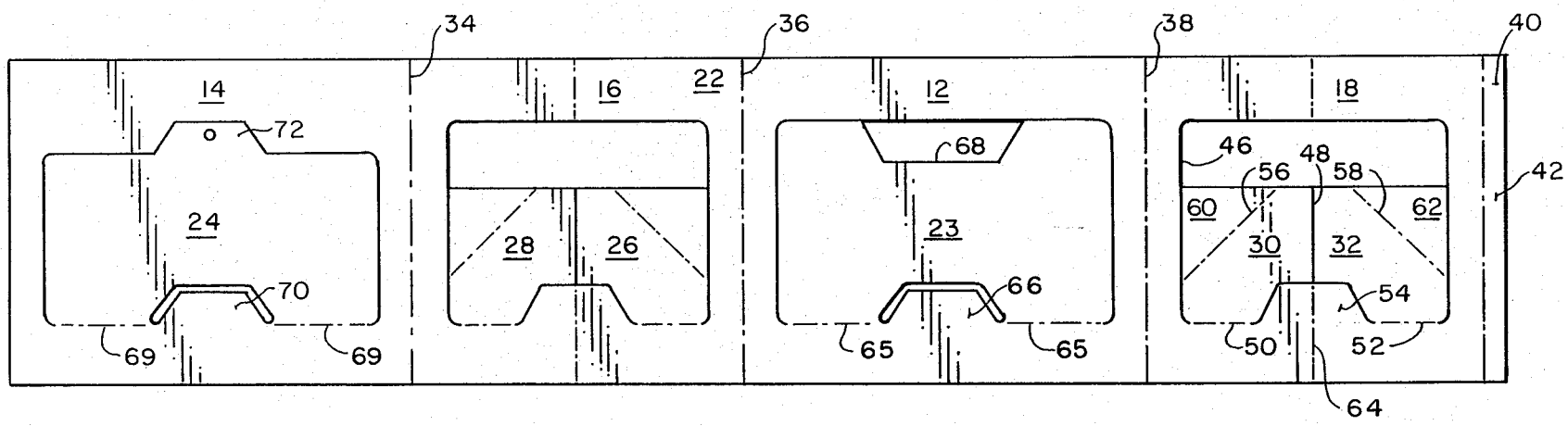
FIG. 1 is a plan view of flattened blank used to define a display device according to the present invention.

To arrive at the structure in FIG. 2, a rectangular blank 22 of cardboard, as shown in FIG. 1, is utilized. Shelf portions 23 and 24 are stamped directly out of walls 12 and 14 respectively. Shelf portions 26, 28 are stamped directly out of wall 16 and shelf portions 30, 32 are stamped directly out of wall 18. Wall 14 is foldable relative to wall 16 about fold line 34. Walls 12 and 16 are foldable relative to each other about vertical fold line 36, while walls 12 and 18 are foldable relative to each other about vertical fold line 38.

Wall 18 has a turned end 40 and a width between the walls 12, 14 that is less than the width of wall 16 by the thickness of the wall 14. The turned end 40 has a flat surface 42 that facially underlies an inwardly facing, flat surface 44 on the wall 14. The surface 42 on the end 40 and surface 44 on wall 14 are glued together to complete the endless wall structure 10. The top and bottom of the wall structure 10 in FIG. 2 are open.

The side walls 16, 18 have the same configuration, and thus discussion herein will be limited to exemplary wall 18. The wall 18 has a rectangular cutout 46 above the shelf portions 30, 32, to shorten the shelf portions 30, 32 so that no interference occurs between the shelf portions 30, 32 and 23, 24 with the device in a display state, as descibed more fully below. Each of the flaps 30, 32 has a generally rectangular configuration and the flaps 30, 32 are separated from each other by a linear, vertical cut 48. The flaps 30, 32 are integral with the wall 18 along their bottom edges 50, 52 respectively, about which edges the shelf portions 30, 32 fold between the collapsed position, shown in FIG. 2, and display position in FIG. 10. The line of edges 50, 52 is interrupted to define an integral abutment 54, which blocks the passage of articles off of the shelf 21 on the display stand, as hereafter described.

The shelf portion 30 has a perforation line 56 and the shelf portion 32 a corresponding line 58 which lines define triangular-shaped flaps 60, 62 respectively, which are foldable about the lines 56, 58 relative to the shelf portions 30, 32. Line 56 makes a 45° angle with walls 12, 18 with the device in a display state and aligns with the corner at the juncture of walls 12, 18. The other tabs on wall portions 26, 28, 32 are similarly configured in relationship to their respective corners. A vertical fold line 64 or other line of weakening is defined midway between the edges of wall 18 so that the wall 18 can be collapsed into the space 20 in a V-shape.

The shelf portion 23 is struck directly from the wall 12 so as to be integrally attached only along its bottom edge 65 which is interrupted to define an upstanding, integral abutment 66. A trapezoidal cutout 68 is defined in the upper portion of the shelf portion 23 to accept part of the shelf portion 24, as hereafter described. The shelf portion 24 is struck from the wall 14 to be integrally attached only along its bottom edge 69, which is also interrupted to define an upstanding abutment 70 and an integral tab 72, spaced vertically therefrom which is accepted in the cutout 68 with the device in the display state. Each of the shelf portions 23, 24 is foldable about is associated fold line 65, 69 between its collapsed position in FIG. 2 and its display position in FIG. 10.

Once the continuous wall structure has been preformed as in FIG. 2, the flaps 60, 62 are folded inwardly about their respective perforation lines 56, 58 so that the flat inside surfaces 74, 76 of flaps 60, 62 are presented facially against inwardly facing flat surfaces 78, 80 on the shelf portions 30, 32 respectively. The shelf portions 26, 28 on the wall 16 are similarly folded. Glue is then applied to the surfaces 82, 84 on flaps 60, 62, which surfaces 82, 84 face inwardly of the space 20 upon the flaps 60, 62 being folded about the perforation lines 56, 58 to fixedly connect the shelf portions 26, 28 to shelf portions 24, 23, respectively.

Figure 7:
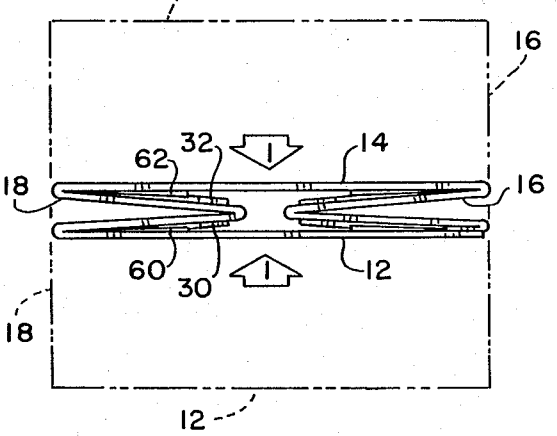
FIG. 7 is a bottom view of the display device in a collapsed state and in which position the two folded shelf portions shown in FIG. 5 are glued to the shelf portions on the other facing walls.
Figure 6:
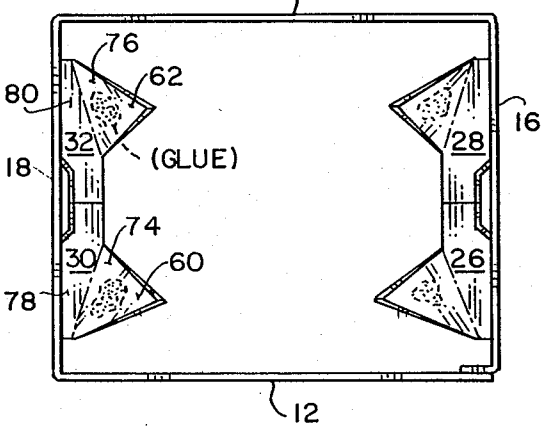
FIG. 6 is a bottom view of the display structure in the FIG. 5 state.
Figure 5:
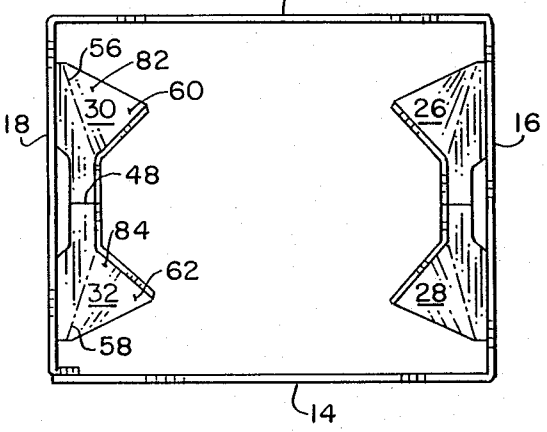
FIG. 5 is a plan view of the display device in the FIG. 2 state and with two shelf portions on the continuous wall structure folded out of the plane of two facing walls.
Figure 3:
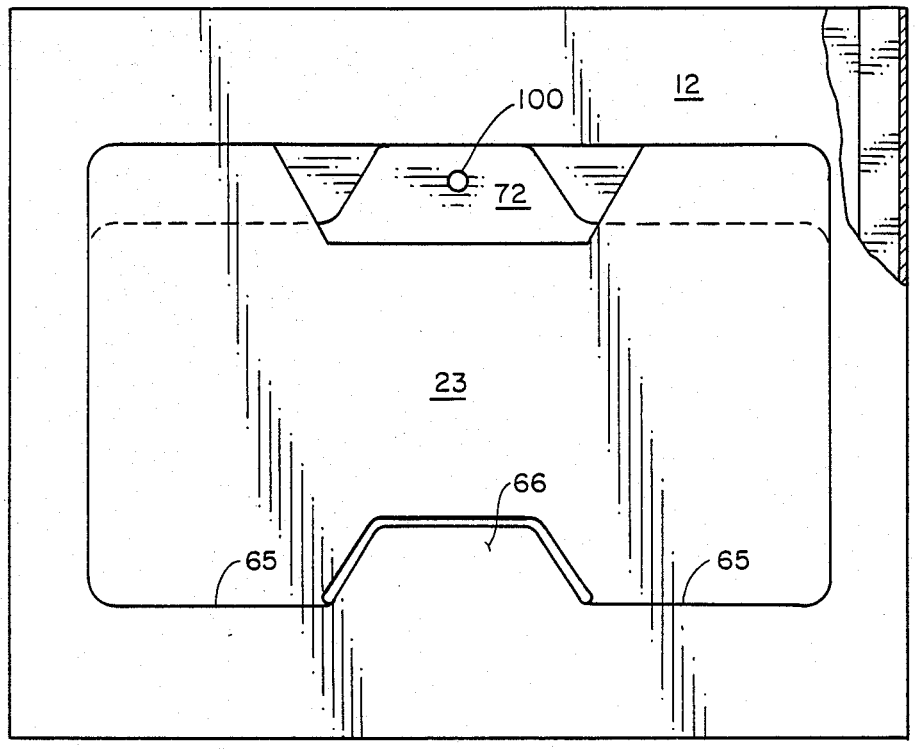
FIG. 3 is a front elevation view of the display device in the partially assembled state of FIG. 2.
Figure 4:
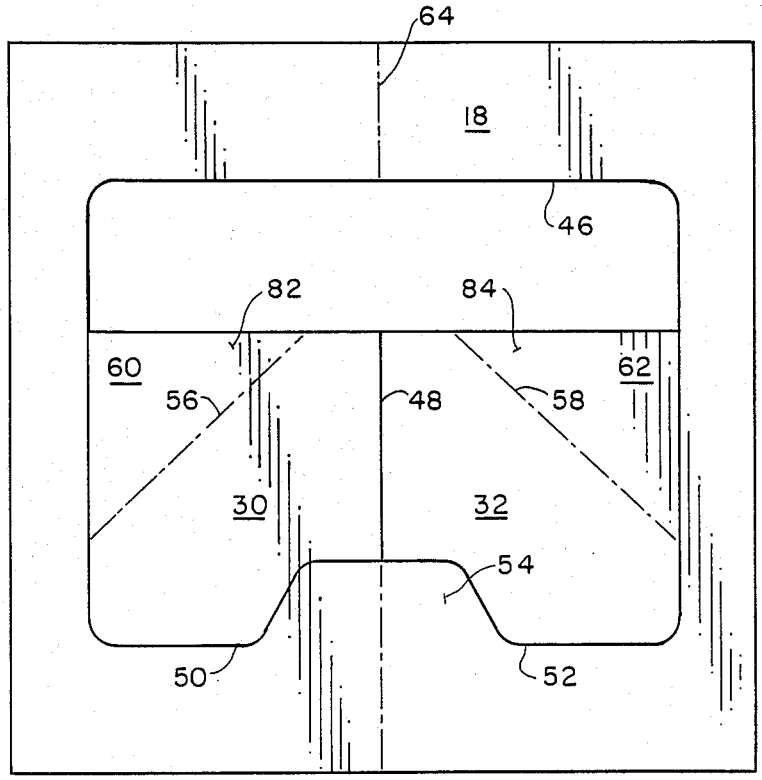
FIG. 4 is a side elevation view of the display device in the partially assembled state of FIG. 2.

The walls 16, 18 are then collapsed inwardly in the direction of arrows 1 towards each other about vertical fold lines 64, as shown in FIG. 7, and the walls 12, 14 move in the process towards each other in parallel relationship as the ends of an accordian. As this occurs, flat, inside surfaces 90, 92 of shelf portions 23, 24 respectively, are presented facially against the surfaces 80,84. This represents the collapsed state for the display device. A pressure is maintained on the structure in its collapsed state until the glue on the flaps 30, 32 and the flat shelf portions 26, 28 has cured.

Once the glue has cured, the walls 12, 14 can be drawn away from each other in the direction of arrows 2 in FIG. 9. As this occurs, the now connected shelf portions 23–32 draw each other away from their respective walls. The shelf portions 23, 24 fold over top of their mating connected shelf portions 26, 30 and 28, 32 respectively. Because the shelf portions 26, 28, 30, 32 are integral with the wall structure 10 and glued to the wall portions 23, 24, they can pivot downwardly to the point where they are substantially horizontally oriented and in that position support the overlying shelf portions 23, 24. Additionally downward pressure on the shelf 21 distorts the wall structure 10 slightly to allow the shelf portions 23, 24 to assume an overcenter portion, shown in FIGS. 10 and 11 in which position the structure is rigidified. In the overcenter position, an interrupted straight free edge 94 on shelf portion 24 bears against and binds with edge 96 on shelf portion 30 and edge 98 on shelf portion 26. The weight of articles on the shelf 21 assures that the overcenter position is maintained.

As the shelf portions 23, 24 fold inwardly towards each other, the tab 72 on shelf portion 24 moves into the cutout 68 on the shelf portion 23 and overlies the outwardly facing surface 94 on the shelf portion 23 so that the shelf portions 23, 24 are mutually overlapping and so that the weight on the shelf 21 portions is borne cooperatively by all of the shelf portions 26, 28, 30, 32.

To collapse the device, the walls 12, 14 are simply moved towards each other. A finger opening 100 in shelf portion 24 facilitates grasping of the portion 24 to draw the shelf out of its overcenter position. The finger opening also facilitates folding of the shelf portion 24 out of the plane of wall 14 as shown in FIG. 2 during initial assembly. The shelf portions naturally assume their collapsed positions. Drawing upwardly on the shelf portion 24, using the finger opening 100, reduces the requisite pressure on the walls 12, 14 to effect collapse.

It can be seen that collapsing and unfolding of the display device involves merely manipulation of two opposite walls 12, 14. In the collapsed state, the device has a depth equal to only four thicknesses of the cardboard and, in the vicinity of the tabs, six thicknesses. The collapsed device is thus very compact.

The cooperation of the shelf portions results in the formation of a stable shelf 21 that is capable of supporting a substantial amount of weight. The shelf portions, upon being folded out of their respective walls, define viewing openings for the merchandise. The integral abutments 66, 70 serve to block merchandise from sliding off the shelves.

In FIG. 12, structure according to the present invention and similar to that in FIGS. 1–11 is shown, however a plurality of vertically spaced shelves 121 are formed. The structure is collapsed and unfolded in the same manner as the single shelf structure and upon unfolding the structure, multiple shelves, and in FIG. 12 three shelves, are automatically defined. The shelf portions in FIG. 12 are numbered with corresponding numbers to those in FIGS. 1–11, with the addition of 100 and are identically configured as those in the first described embodiment.

We claim:

1. A display device comprising:

a continuous wall structure defining a space wherein articles can be placed for display, there being at least two, facing, flat wall pairs on said wall structure;

a first flat shelf portion on one of the flat walls and foldable relative to the one flat wall about a fold line between a collapsed position wherein the first flat shelf portion is substantially parallel to the one flat wall and a display position wherein the first shelf portion is transverse to the one flat wall;

a second flat shelf portion on a second of the flat walls and foldable relative to the second flat wall about a fold line between a collapsed position wherein the second flat shelf portion is substantially parallel to the second flat wall and a display position wherein the second shelf portion is transverse to the second flat wall; and means for fixedly connecting said first and second flat shelf portions to each other and for causing said first and second flat shelf portions to be automatically simultaneously moved out of their collapsed position to their display position upon the facing walls of one of the wall pairs being moved away from each other.

2. A display device according to claim 1 wherein one of said first and second flat shelf portions has an integral flap with oppositely facing flat surfaces and the flap is foldable relative to the one shelf portion about a fold line so that one of the oppositely facing flat flap surfaces is facially against the one shelf portion, and the connecting means fixedly connects the other of the oppositely facing flat flap surfaces to the other of the first and second flat shelf portions.

3. A display device according to claim 2 wherein said first and second flat shelf portions are substantially at right angles to the walls with the shelf portions in their display positions and the fold line about which the flap folds makes an angle of approximately 45° with two of the walls with the first and second shelf portions in their display positions.

4. A display device comprising:

a continuous wall structure defining a space wherein articles can be placed for display, there being at least two interconnected, adjacent walls on said wall structure with flat surfaces that are foldable against each other about a first fold line;

a first flat shelf portion cut directly out of one of the two adjacent walls and foldable relative to the one adjacent wall about a second fold line;

a second flat shelf portion cut directly out of the other of the two adjacent walls and foldable relative to the other adjacent wall about a third fold line;

means for fixedly connecting said first and second flat shelf portions to each other and for causing said first and second flat shelf portions to be automatically simultaneously folded relative to their respective walls to cooperatively define a display shelf having a flat support surface that is transverse to both of the flat surfaces on the two adjacent walls upon the two adjacent walls being unfolded by being moved away from each other about said first fold line, whereby upon unfolding said two adjacent walls a shelf is automatically defined by the first and second flat shelf portions.

5. A display device according to claim 4 wherein one of said first and second flat shelf portions has an integral flap with oppositely facing flat surfaces and the flap is foldable against the one shelf portion so that one of the oppositely facing flat flap surfaces is facially against the one shelf portion, and the connecting means fixedly connects the other of the oppositely facing flat flap surfaces to the other shelf portion.

6. A display device according to claim 4 wherein each of said two adjacent walls has at least two shelf portions which cooperate with each other as the first and second shelf portions so that two spaced shelves are defined.

7. A display device according to claim 4 wherein said display device is constructed from a single cardboard blank.

8. A display device comprising:

a wall structure having two adjacent walls with flat surfaces that are foldable against each other about a first fold line;

a first, flat shelf portion on one of the adjacent walls and foldable relative to the one wall between a collapsed position wherein the shelf portion is substantially parallel to the flat surface on the one wall and an assembled position wherein the shelf portion is transverse to the flat surface on the one wall;

a second, flat shelf portion on the other of the adjacent walls and foldable relative to the other wall between a collapsed position wherein the second shelf portion is substantially parallel to the flat surface on the other wall and an assembled position wherein the shelf portion is transverse to the flat surface on the other wall;

means for fixedly connecting the first and second shelf portions to each other with the shelf portions in their collapsed position and the two adjacent walls folded against each other and for causing the first and second flat shelf portions to draw each other into their assembled positions automatically upon the adjacent walls being folded away from each other.

9. A display device according to claim 8 wherein said display device is constructed from a single cardboard blank.

10. A display device according to claim 8 wherein one of said shelf portions has an associated flap with oppositely facing flat surfaces and the flap is foldable against the one shelf portion so that one of the oppositely facing flat flap surfaces is facially against the one shelf portion, and the connecting means fixedly connects the other of the flat flap surfaces to the other shelf portion.

11. A display device comprising:

a continuous wall structure having first and second substantially flat, facing wall pairs;

a flat shelf portion associated with each wall of the wall pairs with each shelf portion being foldable relative to its associated wall between a collapsed position wherein the shelf portion is substantially parallel to its associated wall and a display position wherein the shelf portion is transverse to its associated wall;

means for fixedly connecting a first and second of the shelf portions on one wall pair with a third and fourth shelf portion on the other wall pair and for causing all of the flap portions to be automatically folded towards their collapsed position upon the walls of one wall pair being moved towards each other and into a collapsed state and for causing all of the shelf portions to be automatically moved towards their display position wherein the shelf portions cooperatively define a shelf upon the walls of the one wall pair being moved away from each other to a display state.

12. A display device according to claim 11 wherein said display device is constructed from a single blank of cardboard.

13. A display device according to claim 11 wherein a first wall on the one wall pair is integral with and foldable relative to a third wall on the other wall pair, said first shelf portion is on the first wall, said third shelf portion is on the third wall and the connecting means interconnects the first and third shelf portions.

14. A display device according to claim 13 wherein the third shelf portion has a flap with oppositely facing flat surfaces and the flap is foldable so that one of the oppositely facing flat flap surfaces is facially against the third shelf portion and the connecting means fixedly connects the other of the oppositely facing flat flap surfaces to the first shelf portion.

15. A display device according to claim 11 wherein the first and second shelf portions are in mutually overlapping relationship with the walls of the one wall pair moved away from each other to the display state.

16. A display device according to claim 11 wherein each of the walls in the other wall pair is foldable against itself to permit the walls of the one wall pair to be moved towards and away from each other.

17. A display device according to claim 11 wherein each wall of the other wall pair has two shelf portions and each of the shelf portion on the one wall pair is connected to two shelf portions on the other wall pair.

* * * * *